US006784724B2

(12) United States Patent
Takemura

(10) Patent No.: US 6,784,724 B2
(45) Date of Patent: Aug. 31, 2004

(54) CONSTANT VOLTAGE GENERATING CIRCUIT

(75) Inventor: Ko Takemura, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/365,500

(22) Filed: Feb. 13, 2003

(65) Prior Publication Data

US 2003/0151451 A1 Aug. 14, 2003

(30) Foreign Application Priority Data

Feb. 14, 2002 (JP) ..... 2002-036938

(51) Int. Cl.[7] ..... G05F 1/10
(52) U.S. Cl. ..... 327/539; 323/313
(58) Field of Search ..... 327/142, 143, 327/539, 540, 543; 323/313

(56) References Cited

U.S. PATENT DOCUMENTS 5,852,376 A * 12/1998 Kraus ..... 327/143
5,867,047 A * 2/1999 Kraus ..... 327/143
6,057,721 A * 5/2000 Nolan et al. ..... 327/143
6,150,872 A * 11/2000 McNeill et al. ..... 327/539
6,204,653 B1 * 3/2001 Wouters et al. ..... 323/313
6,346,849 B1 * 2/2002 Pioppo ..... 327/539
6,437,614 B1 * 8/2002 Chen ..... 327/143
2001/0019281 A1 * 9/2001 Polizzi et al. ..... 327/143
2002/0145455 A1 * 10/2002 Wang ..... 327/143

FOREIGN PATENT DOCUMENTS

JP 07-230332 A1 8/1995
JP 08-166829 A1 6/1996

* cited by examiner

*Primary Examiner*—Terry D. Cunningham
(74) *Attorney, Agent, or Firm*—Morgan, Lewis & Bockius LLP

(57) ABSTRACT

A constant voltage generating circuit has a reference voltage generating circuit of which the output voltage is controlled to be a constant voltage when the output voltage has risen, with an increase in the input supply voltage, to reach a predetermined voltage and that outputs the constant voltage as a reference voltage, a first transistor that turns on when the output voltage reaches the predetermined voltage to control the constant voltage output from the reference voltage generating circuit, a second transistor that is so connected that, when the first transistor turns on, a current proportional to the current flowing through the first transistor flows through the second transistor, and a signal output circuit that detects the current flowing through the second transistor to output a detection signal indicating that the constant voltage is being output.

7 Claims, 4 Drawing Sheets

CONSTANT VOLTAGE GENERATING CIRCUIT

BACKGROUND OF THE INVENTION

1. Field of the Invention

The present invention relates to a constant voltage generating circuit for generating a reference voltage needed by a circuit such as a power supply circuit, and in particular to a constant voltage generating circuit that can detect the starting of a low voltage without fail despite operating from a supply voltage lower than is conventionally required.

2. Description of the Prior Art

Circuits that operate with high accuracy and stability from a wide range of operating voltages and in a wide range of operating temperatures, such as power supply circuits, D/A converters, and A/D converters, require as their reference voltage a constant voltage that is highly accurate and stable. For example, in a PWM-type switching regulator, the accuracy and stability of the reference voltage fed thereto greatly affects, among others, the differential voltage amplification factor and the in-phase component suppression ratio of the error amplifier and the PWM comparator provided within the IC used in the switching regulator. For this reason, where high accuracy is required, the constant voltage generating circuit incorporated in the IC generates a constant voltage by the use of a band-gap circuit that exhibits almost no dependence on temperature.

Such a constant voltage generating circuit operates from a supply voltage input thereto, and accordingly the output voltage of the constant voltage generating circuit rises as the input supply voltage rises. Thus, whether the output voltage remains stable at a predetermined voltage or not is greatly affected by how the input supply voltage rises and how it fluctuates. Therefore, it is essential to check first whether the voltage generated by the constant voltage generating circuit has certainly reached the predetermined constant voltage and whether the input supply voltage has reached a voltage that permits the generation of the predetermined constant voltage, before feeding the constant voltage to circuits that need it as a reference voltage. Failing to do this may lead to malfunctioning and, with a power supply circuit, even destruction of the circuit connected as a load thereto or of the power supply circuit itself.

FIG. 3 shows an example of a conventional constant voltage generating circuit. In FIG. 3, the constant voltage generating circuit 10 generates an output voltage Vref by the use of, for example, a band-gap circuit 1. The output voltage Vref is fed to the inverting input terminal (−) of a comparator A1, and a division voltage Vd obtained by dividing an input supply voltage $V_{IN}$ with resistors R4 and R5 is fed back to the non-inverting input terminal (+) of the comparator A1. How the band-gap circuit 1 is configured and how it operates to generate the output voltage will be described later.

The output terminal of the comparator A1 is connected to the base of an NPN-type, common-emitter connection transistor Tr1 whose collector is pulled up through a resistor R3 to the input supply voltage $V_{IN}$. When the output voltage Vref has reached a predetermined voltage, the transistor Tr1 outputs, at its collector, a low-level starting signal.

Next, with reference to FIG. 4A, how the conventional constant voltage generating circuit 10 operates will be described. FIG. 4A is a graph showing how the output voltage Vref and the division voltage Vd, obtained by dividing the input supply voltage $V_{IN}$, vary according to the input supply voltage $V_{IN}$. Along the horizontal axis is taken the input supply voltage $V_{IN}$, and along the vertical axis are taken the division voltage Vd and the output voltage Vref. FIG. 4B shows the timing with which the conventional constant voltage generating circuit 10 produces a starting signal. Now, suppose that electric power starts being supplied. Then, as shown in FIG. 4A, in a region A, as the input supply voltage $V_{IN}$ rises, the division voltage Vd rises linearly in proportion thereto. The output voltage Vref also rises as shown in FIG. 4A, and reaches a stable voltage starting point T2, at which the output voltage Vref stabilizes, at the boundary between regions B and C.

However, the stable voltage starting point T2 varies greatly with variations in temperature and in the constants of the circuit elements. Thus, in the conventional circuit configuration, a starting signal is output after checking whether or not the input supply voltage $V_{IN}$ is sufficiently high to permit the output voltage Vref to certainly reach the stable voltage starting point T2 even under the influence of variations in temperature and in the constants of the circuit elements. Accordingly, in the comparator A1 shown in FIG. 3, the division voltage Vd of the input supply voltage $V_{IN}$ is compared with the output voltage Vref. Then, as indicated by a comparator detection point T3 in FIG. 4A, the comparator A1 outputs a high-level signal as late as when $Vd \geqq Vref$, i.e., when the region C has been passed through. This high-level signal turns the transistor Tr1 on, which then outputs, for example, a low-level starting signal as shown in FIG. 4B. The relationship $Vd \geqq Vref$ holds also in the region A in FIG. 4A, but, in this region, since the input supply voltage $V_{IN}$ is very low, the comparator A1 does not operate and thus does not output a signal, and accordingly the transistor Tr1 is not turned on.

Likewise, when, as a result of electric power being shut off, or a fault in the circuitry, or a variation in the load, the input supply voltage $V_{IN}$ falls below the comparator detection point T3, the starting signal is stopped (turned to a high level) before it becomes impossible to keep the output voltage Vref at the predetermined voltage. In this way, it is possible to stop the operation of other circuits that use the output voltage Vref as a reference voltage before they start malfunctioning.

As described above, the stable voltage starting point T2, at which the output voltage Vref stabilizes, varies greatly with variations in temperature and in the constants of the circuit elements, and accordingly, in the conventional circuit configuration, a starting signal is output as late as at the comparator detection point T3 after checking whether or not the input supply voltage $V_{IN}$ is sufficiently high to permit the output voltage Vref to certainly reach the stable voltage starting point T2 even under the influence of variations in temperature and in the constants of the circuit elements. This makes it necessary to secure a margin, i.e., the region C shown in FIG. 4A. As a result, an IC circuit that uses as a reference voltage the output from a conventional constant voltage generating circuit cannot be designed to operate from a low input supply voltage, that is, it is impossible to lower the minimum operating voltage from which it can operate. This often makes it impossible to realize operation at a low voltage as required in information technology equipment.

SUMMARY OF THE INVENTION

An object of the present invention is to provide a constant voltage generating circuit that does not require the checking, as required in a conventional one, of whether or not the input supply voltage is sufficiently high to permit the generation of an output voltage stable at a predetermined voltage and that requires less circuit elements, operates from a lower input supply voltage, and thus consumes less electric power than a conventional one.

To achieve the above object, according to one aspect of the present invention, a constant voltage generating circuit is provided with: a reference voltage generating circuit of which that output voltage is so controlled as to be a constant voltage when the output voltage has risen, with an increase in the input supply voltage, to reach a predetermined voltage and that outputs the constant voltage as a reference voltage; a first transistor that turns on when the output voltage reaches the predetermined voltage in order to control the constant voltage output from the reference voltage generating circuit; a second transistor that is so connected that, when the first transistor turns on, a current proportional to the current flowing through the first transistor flows-through the second transistor; and a signal output circuit that detects the current flowing through the second transistor to output a detection signal indicating that the constant voltage is being output.

The second transistor may be given identical characteristics with the first transistor. Alternatively, the second transistor may constitute a current mirror circuit together with the first transistor.

The reference voltage generating circuit may be configured as a band-gap circuit that generates a band-gap voltage.

In a case where the reference voltage generating circuit is a band-gap circuit, the band-gap voltage output from the band-gap circuit is so controlled as to be a constant voltage as a result of a predetermined current flowing through the band-gap circuit. The first transistor controls the current flowing through the band-gap circuit so that the current is kept at a predetermined level by negatively feeding back the current when the output voltage reaches the predetermined voltage. The first and second transistors have bases thereof connected together and have emitters thereof connected together so that a current proportional to the current flowing through the first transistor flows through the second transistor. The signal output circuit outputs, as the detection signal, a signal based on the current flowing through the second transistor.

According to another aspect of the present invention, a constant voltage generating circuit is provided with: a reference voltage generating circuit that generates a reference voltage; an amplification control circuit that receives the reference voltage as an input voltage and amplifies the reference voltage so that an output voltage remains a constant voltage after having reached a predetermined voltage; a first transistor that turns on and permits a current to flow therethrough when the output voltage reaches the predetermined voltage in order to keep the output voltage constant; a second transistor that is so connected that, when the first transistor turns on and permits a current to flow therethrough, a current proportional to a current flowing through the first transistor flows through the second transistor; and a signal output circuit that detects the current flowing through the second transistor to output a detection signal indicating that the constant voltage is being output.

Here, the second transistor may be given identical characteristics with the first transistor. Alternatively, the second transistor may constitute a current mirror circuit together with the first transistor.

The reference voltage generating circuit may be configured as a band-gap circuit that generates a band-gap voltage.

The amplification control circuit may include an amplifier that controls the output voltage so that the output voltage is kept at the predetermined voltage by negatively feeding back a voltage commensurate with the output voltage and comparing the voltage so fed back with the reference voltage. In this case, the first transistor receives the signal output from the amplifier, and permits a current to flow therethrough when the output voltage reaches the predetermined voltage. The first and second transistors have bases thereof connected together and have emitters thereof connected together so that a current proportional to the current flowing through the first transistor flows through the second transistor. The signal output circuit outputs, as the detection signal, a signal based on the current flowing through the second transistor.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
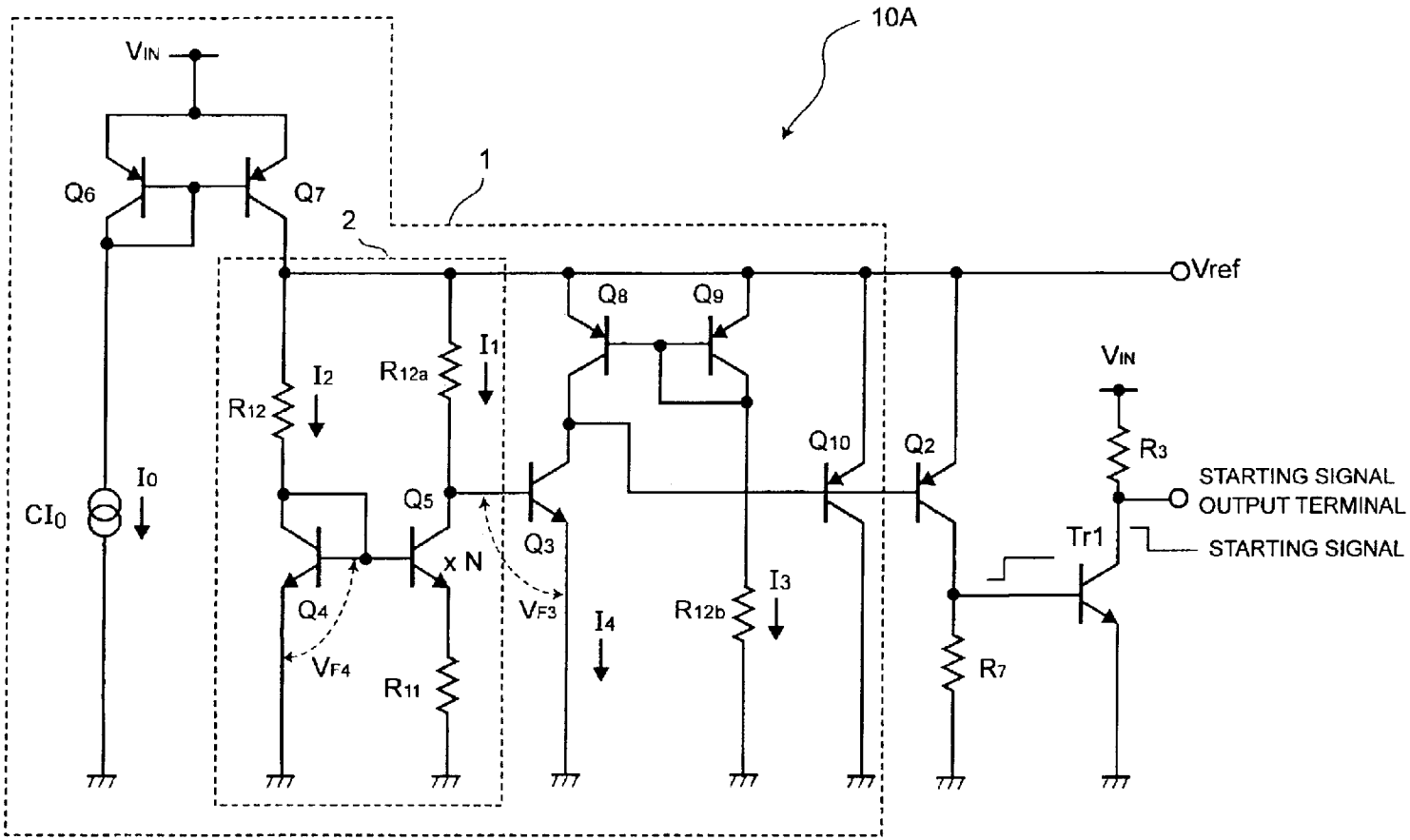
FIG. 1 is a circuit diagram of the constant voltage generating circuit, using a band-gap circuit, of a first embodiment of the invention.
Figure 2:
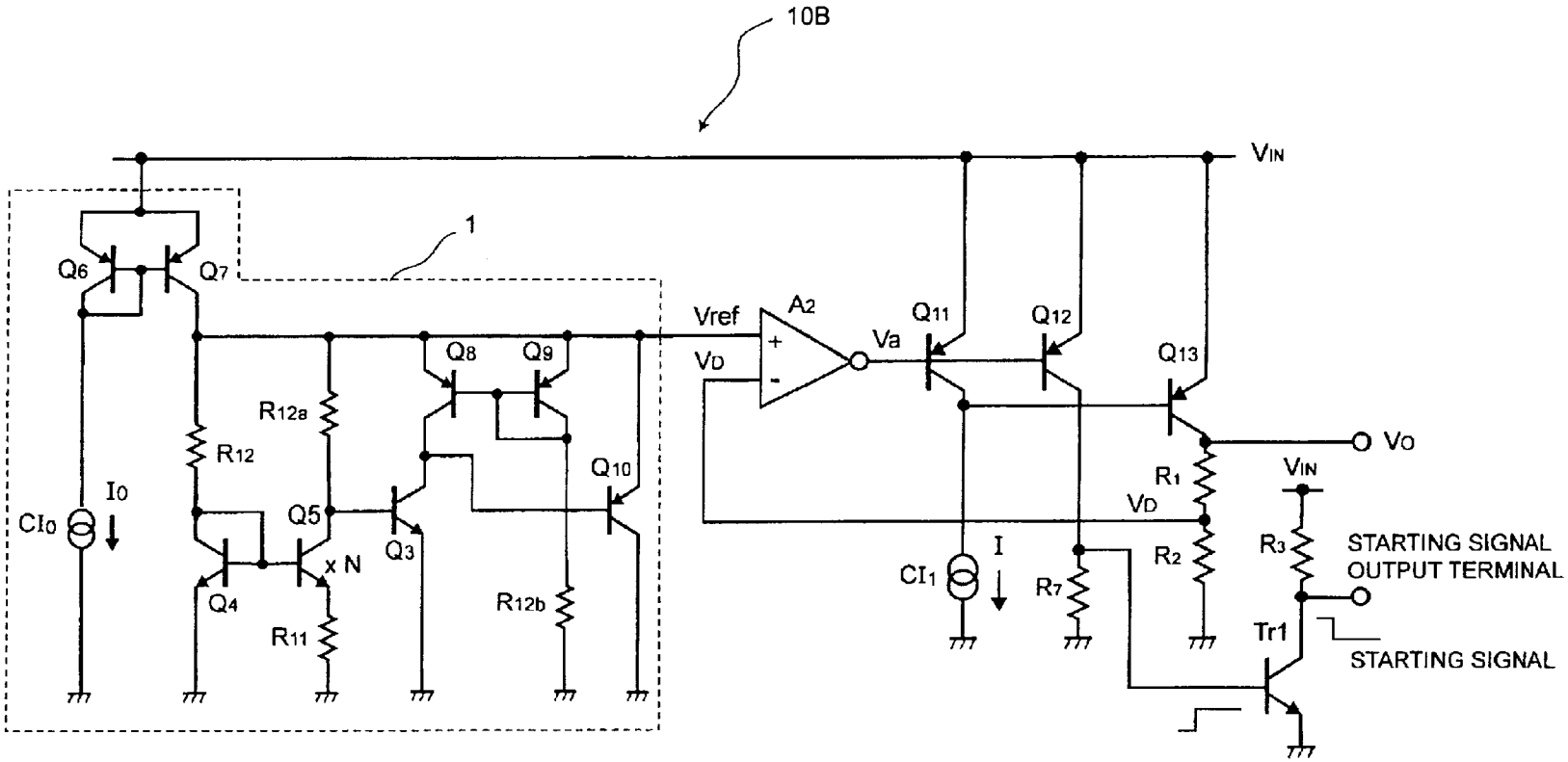
FIG. 2 is a circuit diagram of the constant voltage generating circuit, using a band-gap circuit and an amplifier, of a second embodiment of the invention.
Figure 3:
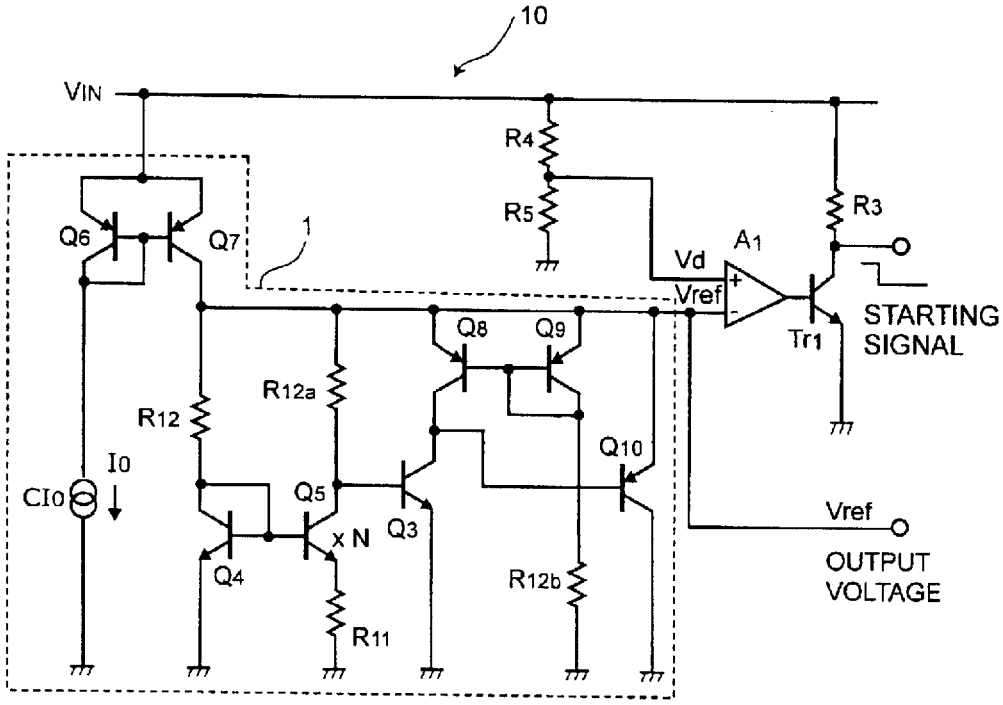
FIG. 3 PRIOR ART
FIG. 3 is a circuit diagram of an example of a conventional constant voltage generating circuit.
Figure 4A:
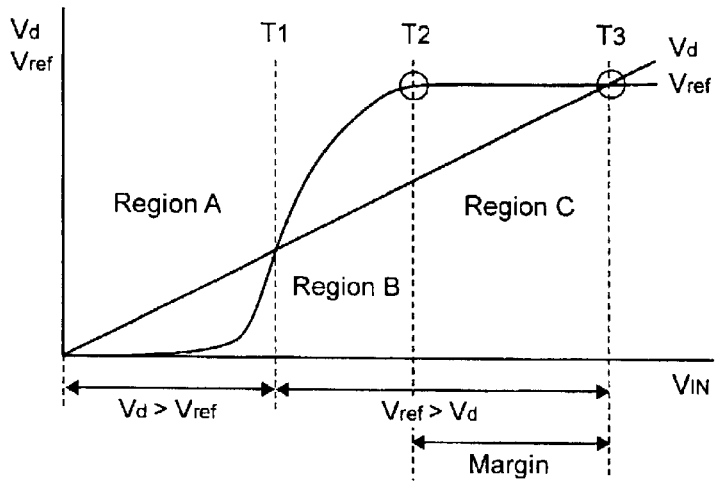
FIG. 4A is a graph showing how the output voltage and the division voltage vary according to the input supply voltage.
Figure 4B:
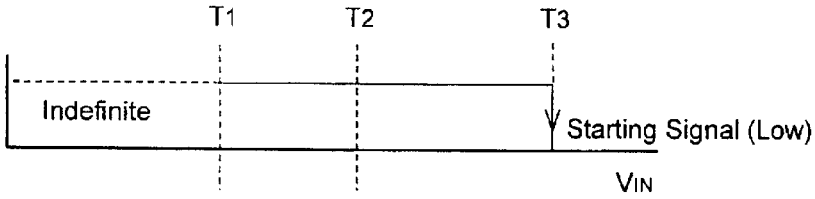
FIG. 4B PRIOR ART
FIG. 4B is a diagram showing the timing with which a conventional constant voltage generating circuit produces a starting signal.
Figure 4C:
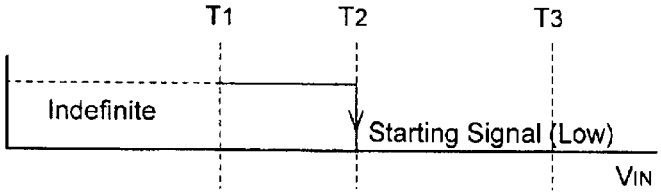
FIG. 4C is a diagram showing the timing with which a constant voltage generating circuit according to the invention produces a starting signal

Hereinafter, embodiments of the present invention will be described with reference to FIGS. 1, 2, 4A, and 4C. In these figures, such elements as are found also in FIGS. 3 and 4B are identified with the same reference numerals. First, a first embodiment of the invention will be described with reference to FIG. 1. FIG. 1 shows the constant voltage generating circuit of the first embodiment which uses a band-gap circuit. FIG. 4C shows the timing with which a constant voltage generating circuit according to the invention produces a starting signal.

The constant voltage generating circuit 10A includes a band-gap-type constant voltage circuit 1. In this constant voltage circuit 1, PNP-type transistors Q6 and Q7 have their bases connected together, and have their emitters connected together, with the collector of the transistor Q6 connected to the bases so connected together, constituting a current mirror circuit as a whole. An input supply voltage $V_{IN}$ is fed to the emitters so connected together. The collector of the transistor Q6 is grounded through a constant-current source CI0. NPN-type transistors Q4 and Q5 have their bases connected together, with the collector of the transistor Q4 connected to the bases so connected together, constituting, together with resistors R11, R12, and R12*a*, a band-gap circuit 2 as a whole. Here, the emitter junction area of the transistor Q5 is N times that of the transistor Q4.

The collector of the transistor Q5 is connected to the base of an NPN-type transistor Q3. The collector of this transistor Q3 is connected to the collector of a PNP-type transistor Q8, which, together with another PNP transistor Q9, constitutes a current mirror circuit located on the upstream side of the transistor Q3. The collector of the transistor Q9 is connected to the bases, connected together, of the transistors Q8 and Q9, and is also grounded through a resistor R12*b*. The node at which the collectors of the transistors Q8 and Q3 are connected together is connected to the bases, connected together, of PNP-type transistors Q10 and Q2, which constitutes a pair of transistors with identical characteristics. The node between the collector of the transistor Q2 and a resistor R7 is connected to the base of an NPN-type transistor Tr1, and the collector of the transistor Tr1 is pulled up through a resistor R3 to the input supply voltage $V_{IN}$, and is also connected to a starting signal output terminal by way of which a starting signal is fed out. The resistors R12, R12*a*, and R12*b* have equal resistances. A multiple-collector transistor may be used as the transistors Q10 and Q2, because these transistors have their bases connected together and have their emitters connected together.

Let the current flowing through the resistor R12 be I2, the current flowing through the resistor R12*a* be I1, the current flowing through the emitter of the transistor Q3 be I4, the output voltage be Vref, the base-emitter voltage of the transistors Q3 and Q4 be VF3 and VF4, respectively, and the thermal voltage appearing in the transistor Q5 in proportion to the absolute temperature be VT. Then, according to the Japanese Patent Application Laid-Open No. H7-230332, I1 and I2 are given by $$I1=VT\times LnN/R11$$

$$I2=(Vref-VF4)/R12$$

That is, the current I1 does not depend on the input supply voltage $V_{IN}$ or the output voltage Vref, and is thus a constant current unless the absolute temperature varies.

As the input supply voltage $V_{IN}$ rises, the output voltage Vref rises, and accordingly the current I2 increases. Meanwhile, the current I3 flowing through the resistor R12*b* connected to the collector of the transistor Q9, i.e., one of the transistors constituting a current mirror circuit, also increases. However, the base-emitter voltage VF3 of the transistor Q3 does not make the base potential of the transistor Q3 sufficiently high to turn the transistor Q3 on. Thus, no current I4 flows through the transistor Q3, and therefore the collector potential of the transistor Q8 remains at a high level, i.e., equal to the output voltage Vref. The transistors Q10 and Q2 receive this high level at their bases, and therefore no current flows through these transistors.

As the output voltage Vref further rises, the current I2 further increases. When I2 becomes equal to I1, the following relationships hold:

$$Vref=I2\times R12+VF4$$

$$Vref=I2\times R12a+VF3$$

Here, since the resistors R12 and R12*a* have equal resistances, VF3=VF4. The above equations give VF3= Vref−I1×R12*a*.

Here, according to the above equations, as the input supply voltage $V_{IN}$ further rises, and as a result the output voltage Vref tends to rise further, since the I1 is constant as described above, the voltage VF3 rises. This turns the transistor Q3 on, and thus causes a current I4 proportional to the current I3 to start flowing through the transistor Q8, i.e., the other of the transistors constituting the current mirror circuit. Simultaneously, the base potential of the transistors Q10 and Q2 falls and turns them on.

The transistor Q6, i.e., one of the transistors constituting another current mirror circuit, has the constant-current source CI0 so connected as to supply a constant current I0 thereto from the downstream side thereof. Thus, the currents flowing through the transistors Q6 and Q7 are balanced with each other so that the current flowing through the transistor Q7 is kept equal to the current I0 supplied from the constant-current source CI0. Accordingly, when the output voltage Vref tends to rise further, the voltage VF3 also tends to rise further, lowering the collector potential of the transistor Q3 and thereby further increasing the currents flowing through the transistors Q10 and Q2. Thus, the increments in the currents I2, I3, and I4 resulting from the further rise in the output voltage Vref tend to be absorbed by the transistors Q10 and Q2. However, these currents that the transistors Q10 and Q2 tend to absorb to increase the currents flowing through themselves are suppressed because the current I0 flowing through one of the transistors Q6 and Q7 constituting the current mirror circuit is constant. Thus, the currents I2, I3, and I4 cannot increase any further, and a stable state is attained in which I1=I2=I3=I4. That is, the currents that tend to flow through the transistors Q10 and Q2 act to effect negative current feedback on the current flowing through the transistor Q7. Thus, the currents I2, I3, and I4 stabilize when they become equal to I1. At this time, the output voltage Vref has reached the stable voltage of the band-gap circuit 2, for example 1.24 V, and the output voltage Vref is thereafter so controlled as to stably remain at this constant voltage.

Here, since the transistors Q10 and Q2 have equal characteristics, have their emitters connected together, and have their bases connected together, when the output voltage Vref has reached the stable voltage starting point described above, as one transistor Q10 is turned on and a current flows therethrough, a current proportional thereto flows also through the other transistor Q2. By detecting this current across the resistor R7 connected between the collector of the transistor Q2 and ground and then turning the NPN-type transistor Tr1 on, it is possible to feed out a low-level starting signal via the starting signal output terminal. In this case, the starting signal is output, as shown in FIG. 4C, at a time point corresponding to the stable voltage starting point T2 shown in FIG. 4A. That is, the starting signal is output earlier than at the comparator detection point T3 shown in FIG. 4B as is the case with the conventional circuit, i.e., the starting signal is output when the input supply voltage $V_{IN}$ is still low.

Next, a second embodiment of the invention will be described with reference to FIGS. 2 and 4. FIG. 2 shows the constant voltage generating circuit of the second embodiment which outputs the reference voltage generated by a band-gap circuit after amplifying it. In this figure, such elements as operate in the same manner as in FIGS. 1 and 3 are identified with the same reference numerals.

In some cases, a plurality of circuits within an IC require a higher reference voltage, or require a current together with a reference voltage. The constant voltage generating circuit 10B shown in FIG. 2 not only uses a band-gap-type constant voltage circuit 1 to generate a reference voltage Vref, but also includes an amplifier A2 for amplifying the voltage and an amplification control circuit for outputting the voltage with enhanced current capacity to meet such demands. Even in such cases, just as in the first embodiment, it is necessary to supply the generated output voltage $V_O$ together with a starting signal to the plurality of circuits within the IC mentioned above as soon as the voltage has reached the stable voltage starting point T2. To achieve that, in this embodiment, the reference voltage Vref generated by the band-gap circuit 1 is fed to the non-inverting input terminal (+) of the amplifier A2, and a division voltage $V_D$ obtained by dividing the output voltage $V_O$ of the constant voltage generating circuit 10B with resistors R1 and R2 is negatively fed back to the inverting input terminal (−) of the amplifier A2. The configuration and operation of the band-gap circuit 1 are the same as described earlier with reference to FIG. 1, and therefore overlapping explanations will be omitted.

The output terminal of the amplifier A2 is connected to the base of a PNP-type transistor Q11. The transistor Q11 has its emitter connected to the input supply voltage $V_{IN}$, and has its collector grounded through a passive constant-current source CI1 composed of a transistor or the like. The transistor Q11 and a transistor Q12, having identical characteristics with the transistor Q11, have their bases connected together, and have their emitters connected together. Thus, through the transistor Q12 flows a current proportional to the current flowing through the transistor Q11. The base of an NPN-type transistor Tr1 is connected to the node between the collector of the transistor Q12 and a resistor R7 so as to receive the output of the transistor Q12. A transistor Q13 has its emitter connected to the input supply voltage $V_{IN}$, and has its collector grounded through serially connected resistors R1 and R2. The transistor Q13 outputs, at its collector, the output voltage $V_O$ to be used as a reference voltage by other circuits. A multiple-collector transistor may be used as the transistors Q11 and Q12, because these transistors have their bases connected together and have their emitters connected together.

Next, how this circuit operates will be described, excluding the operation of the band-gap circuit 1. Now, suppose that the amplifier A2 has a sufficiently high gain. Then, the output voltage Va of the amplifier A2 is given by $$Va=Vref\times(R1+R2)/R2$$

Here, when the division voltage $V_D$ obtained from the output voltage $V_O$ and fed to the inverting input terminal (−) of the amplifier A2, i.e., $V_D=V_O\times R2/(R1+R2)$, is lower than the reference voltage Vref, the output of the amplifier A2 makes the base voltage of the transistor Q11 so high that the transistor Q11 does not operate. Thus, the base current of the transistor Q13 flows into the constant-current source CI1, which is connected to the transistor Q11. This turns the transistor Q13 on, and causes the division voltage $V_D$ to be produced and negatively fed back to the amplifier A2. As the input supply voltage $V_{IN}$ rises, the division voltage $V_D$ further rises. When the division voltage $V_D$ becomes equal to the reference voltage Vref, the output voltage Va of the amplifier A2 lowers. This turns the transistor Q11 on, and causes a current to flow from the emitter thereof into the constant-current source CI1. That is, the collector voltage of the transistor Q11 rises in the direction in which the collector current of the transistor Q13 is reduced. Thus, the rise in the output voltage $V_O$, resulting from the voltage drop across the resistors R1 and R2 caused by the collector current of the transistor Q13, stops. In this way, the output voltage $V_O$ reaches the stable voltage starting point T2, and is thereafter so controlled as to remain constant.

As described above, in the circuit shown in FIG. 2, no current flows through the transistor Q11 until the division voltage $V_D$ obtained from the output voltage $V_O$ becomes equal to the reference voltage Vref, i.e., until the output voltage $V_O$ reaches the stable voltage starting point T2. Therefore, by adding the transistor Q12 having identical characteristics with the transistor Q11 so that the transistors Q11 and Q12 together constitute a current mirror circuit as shown in FIG. 2, it is possible, when the transistor Q11 is turned on and a current flows therethrough, to make a current proportional thereto flow through the transistor Q12. To detect this current, the collector of the transistor Q12 is grounded through the resistor R7, the node between the collector and the resistor R7 is connected to the base of the NON-type transistor Tr1, and the collector of the transistor Tr1 is connected through the resistor R3 to the input supply voltage $V_{IN}$. In this configuration, when a current flows through the transistor Q12, the transistor Tr1 turns on, and outputs, at its collector, a low level starting signal. In this case, the starting signal is output at the stable voltage starting point T2 as shown in FIG. 4C. That is, the starting signal is output earlier than in the conventional circuit (earlier than at the comparator detection point T3 shown in FIG. 4B), i.e., the starting signal is output when the input supply voltage $V_{IN}$ is still low.

The first and second embodiments described above deal with constant voltage generating circuits that generate a reference voltage by the use of a band-gap circuit. However, a reference voltage may be generated by the use of any other type of circuit than specifically described above. Even in that case, provided that the circuit includes a transistor that turns on when the generated reference voltage reaches the stable voltage starting point T2, by adding to that transistor a transistor having identical characteristics therewith or a device that together constitutes a current mirror circuit so that the added transistor or device detects the starting of a current through the transistor that has turned on, it is possible to readily detect whether the reference voltage has reached the stable voltage starting point T2 or not and then output a starting signal according to the result of the detection. In this and similar ways, too, the prevent invention can be carried out to overcome the problems encountered in the conventional circuit.

As described above, according to the present invention, it is possible to realize a constant voltage generating circuit that does not require the checking, as required in a conventional one, of whether or not the input supply voltage is sufficiently high to permit the generation of an output voltage stable at a predetermined voltage and that requires less circuit elements, operates from a lower input supply voltage, and thus consumes less electric power than a conventional one.

What is claimed is:

1. A constant voltage generating circuit comprising:

a band gap circuit of which an output voltage is so controlled, with a power supply voltage being supplied, as to be a predetermined constant voltage, as a result of a predetermined current level flowing therethrough, and a first transistor that effects negative current feedback when the output voltage reaches the predetermined constant voltage so that current flowing through the band-gap circuit is so controlled as to be the predetermined current level, wherein the constant voltage generating circuit further comprises:

a second transistor having a base and an emitter thereof connected to a base and an emitter of the first transistor respectively, the second transistor that, when current associated with said negative current feedback flows through the first transistor, controls the current flowing through the band-gap circuit so as to be the predetermined current level by negatively feeding back a current proportional to the current flowing through the first transistor;

a resistor arranged in a current pass through which current flowing through the second transistor flows, the resistor generating a voltage drop thereacross when the current proportional to the current flowing through the first transistor and negatively fed back flows therethrough; and a starting signal output circuit that detects the voltage drop generated across the resistor to output a starting signal indicating that the output voltage reaches the predetermined constant voltage, wherein the emitters of the first and second transistors are connected to a band-gap voltage generated by the band-gap circuit so that the current flowing through the first transistor and the current flowing through the second transistor are negatively fed back to the band-gap circuit.

2. A constant voltage generating circuit as claimed in claim 1, wherein the second transistor has identical characteristics with the first transistor.

3. A constant voltage generating circuit as claimed in claim 1, wherein the second transistor constitutes a current mirror circuit together with the first transistor.

4. A constant voltage generating circuit comprising an output stage providing an output voltage and a voltage commensurate with the output voltage so that the output voltage is outputted by being so controlled to be a predetermined constant voltage that is different from a reference voltage;

an amplifier for comparing voltages between the reference voltage and the voltage commensurate with the output voltage, and amplifying a difference therebetween to output;

a first transistor having a base thereof for receiving an output from the amplifier and a collector thereof connected to a constant current source to control the output stage;

a second transistor having a base and an emitter thereof connected to the base and an emitter of the first transistor respectively, the second transistor permitting a current proportional to a current flowing through the first transistor to flow therethrough;

a resistor arranged in a current pass through which the current flowing through the second transistor flows and generating a voltage drop thereacross; and a starting signal output circuit that detects the voltage drop generated across the resistor to output a starting signal indicating that the output voltage reaches the predetermined constant voltage.

5. A constant voltage generating circuit as claimed in claim 4, wherein the second transistor has identical characteristics with the first transistor.

6. A constant voltage generating circuit as claimed in claim 4, wherein the second transistor constitutes a current mirror circuit together with the first transistor.

7. A constant voltage generating circuit as claimed in claim 4, wherein the reference voltage generating circuit is a band-gap circuit that generates a band-gap voltage.

* * * * *